United States Patent [19]

Dollman

[11] 4,370,173

[45] Jan. 25, 1983

[54] COMPOSITION AND METHOD FOR ACID CLEANING OF ALUMINUM SURFACES

[75] Inventor: David Y. Dollman, Doylestown, Pa.

[73] Assignee: Amchem Products, Inc., Ambler, Pa.

[21] Appl. No.: 373,211

[22] Filed: Apr. 30, 1982

Related U.S. Application Data

[63] Continuation-in-part of Ser. No. 263,838, May 15, 1981, abandoned.

[51] Int. Cl.[3] ..... B08B 3/08; C23G 1/12; C11D 7/08

[52] U.S. Cl. ..... 134/3; 134/40; 134/41; 252/142

[58] Field of Search ..... 134/3, 40, 41; 252/89.1, 142

[56] References Cited

U.S. PATENT DOCUMENTS 3,969,135 7/1976 King et al. ..... 134/41
4,009,115 2/1977 Binns ..... 252/142
4,116,853 9/1978 Binns ..... 252/142
4,124,407 11/1978 Binns ..... 134/3

OTHER PUBLICATIONS

McCutcheon, *Detergents and Emulsifiers,* "Mirawet B," 1980, p. 193.

Miranol Chemical Co., Inc., "Mirawet B," 1967, pp. 1–4.

*Primary Examiner*—Marc L. Caroff

*Attorney, Agent, or Firm*—Ernest G. Szoke; Henry E. Millson, Jr.

[57] ABSTRACT

Lubricating oils and aluminum fines are removed from aluminum surfaces by contacting the surfaces with an aqueous solution containing sulfuric acid, hydrofluoric acid, and an alkali metal 2-butoxyethoxyacetate anionic surfactant. The solution may also contain one or more low foaming nonionic surfactants.

16 Claims, No Drawings

COMPOSITION AND METHOD FOR ACID CLEANING OF ALUMINUM SURFACES

RELATED APPLICATIONS

This application is a continuation-in-part of copending application Ser. No. 263,838, filed May 15, 1981, now abandoned. The disclosure thereof is expressly incorporated herein by reference.

BACKGROUND OF THE INVENTION

In the manufacture of containers composed of aluminum and aluminum alloys, a drawing and forming operation is employed (commonly referred to as drawing and ironing). This operation results in the deposition of lubricants and forming oils on the surfaces of the aluminum containers. In addition, residual aluminum fines, i.e. small particles of aluminum, are deposited on both the interior and exterior surfaces. Ordinarily, the exterior surface of the container will have smaller quantities of aluminum fines than the interior surface since during the drawing and ironing step the exterior surface is not subjected to as much abrasion from the die as the interior surface.

Prior to any processing steps, such as conversion coating and sanitary lacquer deposition, the surfaces of the aluminum containers must be clean and water-break-free, i.e. free of contaminants that interfere with further processing and render the containers unacceptable for use.

Compositions and methods for the low temperature cleaning of aluminum surfaces are disclosed in U.S. Pat. No. 4,009,115 issued Feb. 22, 1977 to Robert Eric Binns, U.S. Pat. No. 4,116,853 issued Sept. 26, 1978 to Robert Eric Binns, U.S. Pat. No. 4,124,407 issued Nov. 7, 1978 to Robert Eric Binns, and U.S. Pat. No. 3,969,135 issued July 13, 1976 to Peter F. King, et al. These patents disclose cleaning compositions containing sulfuric acid, hydrofluoric acid or a fluoride salt, and a surfactant.

Compositions falling within the disclosures of these patents are commercially successful and are in fact used extensively in the cleaning of aluminum and aluminum alloy containers. Such commercial compositions typically utilize a combination of two nonionic surfactants to enhance the cleaning performance and minimize foaming.

One of the problems in utilizing the prior art acid cleaning compositions is caused by the build-up of lubricants and forming oils used in the drawing and forming of aluminum containers as these containers are treated with the cleaning solutions. The cleaning solutions must be replenished with fresh solutions from time to time to keep the oil level down. When the oil levels become excessive in the cleaning bath, containers cleaned in the bath exhibit significant water breaks after the cleaning solution is rinsed off. Water breaks are an indication that the surface of the aluminum is not clean and that oils or other foreign deposits are present. Such cans must be discarded or recleaned since they are not suitable for further processing as containers for beverages and other comestibles.

It has now been discovered that a particular anionic surfactant, i.e., an alkali metal 2-butoxyethoxyacetate, when used alone or in combination with one or more low foaming nonionic surfactants in the sulfur acid/hydrofluoric acid compositions of the prior art, has surprising advantages over known compositions containing the surfactants and surfactant combinations currently in use therein.

It has been found that the cleaning solutions of the present invention can tolerate relatively high concentrations of lubricants and forming oils without any water breaks occurring on the containers cleaned by such solutions. Hence, significant economies are realized since large numbers of containers can be processed before the operation must be shut down in order to replenish all or part of the cleaning solution.

Another significant advantage of the present cleaning compositions is the almost complete absence of foam in the cleaning bath and in the rinsing cycle following the cleaning step. Many of the acid cleaning compositions currently on the market exhibit problems with foam to a greater or lesser extent. Such compositions are mixtures of a high foaming nonionic surfactant to achieve good cleaning action with a low foaming anionic surfactant to try to contain the quantity of foam that would otherwise result. Foaming often results in overflow or dropping of the foam onto the floor of the facility containing the operation, resulting in slippery and unsafe conditions. Also, appearance of foam may lead to the operator's conclusion that the cleaning solution is not satisfactory due to the risks of foam overflow. Accordingly, the container cleaning operations must be shut down while the foam is skimmed off or the cleaning solution is replenished, leading to lost time and decreased flow-through of containers.

A further advantage of the present cleaning compositions is that the alkali metal 2-butoxyethoxyacetate can be utilized effectively in relatively small quantities, and this factor, combined with the already inexpensive cost of this surfactant (as the sodium salt) compared with the nonionic surfactants currently in use, results in great economic savings over the present commercial compositions. Significant cost savings are also realized even when a low foaming nonionic surfactant or a combination of such surfactants is also present in the cleaning composition of the invention, since the nonionic surfactant(s) is also present in relatively small quantities.

Typically, concentrates containing the sulfuric acid and the surfactant are prepared by the manufacturer and sold to container processing companies who make up cleaning solutions by diluting such concentrates with water and adding hydrofluoric acid to the solutions. Concentrates currently on the market tend to be rather highly colored, due to decomposition products formed from the action of concentrated sulfuric acid on the surfactants and/or from interactions between the surfactants and impurities in the commercial sulfuric acid which is commonly used in formulating the concentrates. Surprisingly, concentrates formed with an alkali metal 2-butoxyethoxyacetate as the sole surfactant present are colorless or only slightly yellow in color. Such concentrates are stable at very low temperatures, e.g. no precipitation occurs even at the temperature of a dry ice-acetone bath. Also, the concentrates are stable and do not discolor even when subjected to temperatures at 50° C. for periods of three weeks or more. Most concentrates currently in use discolor even at room temperature, and precipitates form in some when containers of the concentrates are placed in dry ice-acetone baths. The great stability of the present compositions permits their shipment and storage under adverse temperature conditions without problems, a further significant economic advantage.

Another advantage of the present invention is the high level of cleanliness produced in the containers, particularly when a low foaming nonionic surfactant is also present, providing for unusually uniform conversion coating and lacquer deposition on the containers during their further processing.

Interestingly, when the only anionic surfactant disclosed in Binns' U.S. Pat. Nos. 4,009,115; 4,116,853; and 4,124,407, i.e. Tergitol Anionic 08 (sodium 2-ethyl hexyl sulfate), was tested in the acid cleaning compositions of these patents, water breaks occurred on the aluminum containers cleaned with such compositions after the addition of only small quantities of forming oils. Hence, the surprising advantages discovered with the anionic surfactant of the present invention appear to be unique and clearly are not advantages common to anionic surfactants in general.

DETAILED DESCRIPTION OF THE INVENTION

The present invention relates to aqueous cleaning compositions and processes for the cleaning of aluminum surfaces, and to concentrates used in forming the cleaning compositions.

The compositions and processes of the invention comprise improvements over the compositions and processes disclosed and claimed in Binns' U.S. Pat. Nos. 4,009,115; 4,116,853; and 4,124,407; and the disclosures of such patents are specifically incorporated herein by reference. The procedures and methods used therein in carrying out the cleaning operations and in forming the concentrates and cleaning solutions are equally applicable to the present invention unless otherwise stated herein.

The aqueous cleaning compositions of the invention comprise from about 1 to about 10 grams/liter, preferably from about 3 to about 5 grams/liter of sulfuric acid; from about 0.005 to about 0.1 grams/liter, preferably from about 0.01 to about 0.03 grams/liter of hydrofluoric acid; and from about 0.1 to about 10 grams/liter, preferably from about 0.2 to about 0.8 grams/liter of an alkali metal 2-butoxyethoxyacetate. The alkali metal 2-butoxyethoxyacetate is preferably sodium 2-butoxyethoxyacetate $$[CH_3(CH_2)_3OCH_2CH_2OCH_2\overset{\overset{\displaystyle O}{\|}}{C}-O^{\ominus}Na^{\oplus}],$$

sold commercially under the trademark "MIRAWET B" by the Miranol Chemical Company, Inc. as an aqueous solution containing 49.0% sodium 2-butoxyethoxyacetate. Other alkali metal salts can equally well be employed, e.g. potassium 2-butoxyethoxyacetate or lithium 2-butoxyethoxyacetate. Optionally, but preferably, from about 0.1 to about 10 grams/liter, preferably from about 0.2 to about 0.8 grams/liter of one or a combination of two or more low foaming nonionic surfactants is also present. Advantageously, a weight ratio of alkali metal 2-butoxyethoxyacetate to nonionic surfactant of about 1:1 is used.

The term "low foaming nonionic surfactant" means that the nonionic surfactant or combination of nonionic surfactants give less than 20 mm. of foam after five minutes standing in the well known Ross-Miles Foam Test at 50° C. Examples of such low foaming nonionic surfactants that can be used alone or in combination in the practice of the invention include the following:

TRITON DF-16 (Rohm & Haas Co.) a nonionic surfactant believed to be a modified polyethoxylated straight chain alcohol;

POLYTERGENT S-505 LF (Olin Corp.) a nonionic surfactant believed to be a modified polyethoxylated straight chain alcohol;

SURFONIC LF-17 (Jefferson Chemical Co.) a nonionic surfactant believed to be an alkyl polyethoxylated ether;

ANTAROX BL 330 (GAF Corp.) a nonionic surfactant believed to be an alkyl poly(ethyleneoxy) ethanol;

TRITON CF-10 (Rohm & Haas Co.) a nonionic surfactant, and believed to be an alkylaryl polyether having a carbon chain of about 14 carbon atoms and approximately 16 moles of ethoxylation;

PLURONIC LO61 (BASF Wyandotte, Inc.) a nonionic surfactant, and believed to be a condensate containing only ethylene oxide and propylene oxide chains;

ANTAROX LF-330 (GAF Corp.) a nonionic surfactant, believed to be an alkyl poly(ethyleneoxy) ethanol;

MIN-FOAM 1X (Union Carbide Corp.) a nonionic surfactant believed to be alkyloxy(polyethyleneoxypropyleneoxyisopropanol) having a molecular weight of about 706.

The pH of the above cleaning compositions of the invention is preferably maintained in the range of about 1.0 to about 1.8 and most preferably in the range of about 1.2 to about 1.5, although a pH of from about 0.6 to about 2.0 can be used.

The concentrates of the present invention, which advantageously may be used in forming the cleaning solution of the invention, comprise from about 200 to about 600 grams/liter of sulfuric acid and from about 0.01 parts to about 10 parts, and preferably from about 0.04 parts to about 0.27 parts by weight of alkali metal 2-butoxyethoxyacetate per part of sulfuric acid in the concentrate. Using the above ratios for the alkali metal 2-butoxyethoxyacetate as a guide, and depending on the quantity of sulfuric acid desired in the cleaning solution of the invention, the actual quantity of alkali metal 2-butoxyethoxyacetate in the concentrate is determined from within the above ratios so that the desired quantity of alkali metal 2-butoxyethoxyacetate is present in the cleaning solution when the concentrate is diluted with an appropriate quantity of water. For example, if 1 gram/liter of sulfuric acid is desired in the cleaning solution, then from about 0.1 grams to about 10 grams of alkali metal 2-butoxyethoxyacetate is present in the concentrate per gram of sulfuric acid. If 10 grams/liter of sulfuric acid is desired in the cleaning solution, then from about 0.1 grams to about 1 gram of alkali metal 2-butoxyethoxyacetate is present in the concentrate per gram of sulfuric acid.

Optionally, from about 0.01 parts to about 10 parts, preferably from about 0.04 parts to about 0.27 parts by weight of one or a combination of low foaming nonionic surfactants is also present in the concentrates of the invention.

The above concentrate is then added to water in controlled amounts sufficient to produce a cleaning solution having the desired quantities of sulfuric acid and alkali metal 2-butoxyethoxyacetate. Hydrofluoric acid in quantities sufficient to give the desired amount is usually added separately to the cleaning solution. While the hydrofluoric acid can be added to the concentrate in quantities sufficient to produce the requisite amounts in the cleaning solution when the concentrate is added to water, it is much preferred to add the hydrofluoric acid separately to the cleaning solution in carefully metered quantities on a continuing controlled basis. Separate monitored addition of hydrofluoric acid is preferred because the cleaning solution continually loses hydrofluoric acid as etching of the aluminum containers takes place during the cleaning stage.

The process of the invention comprise contacting the aluminum or aluminum alloy surfaces to be cleaned with the aqueous cleaning compositions of the invention using any of the contacting techniques known to the art, such as conventional spray or immersion methods. The temperature of the cleaning composition is preferably maintained in the range of from about 115° F. to about 145° F. for maximum cleaning effect, although temperatures as low as 90° F. can be employed. Treatment times with the cleaning solutions are usually of the order of about 15 seconds to about 2 minutes. Desirably, the hydrofluoric acid content of the cleaning solution and the contact time with the aluminum surfaces is adjusted to give an aluminum dissolution of from about 8 to about 25 milligrams, preferably from about 9 to about 20 milligrams, per square foot of aluminum surface treated at a temperature of 130° F. and a contact time of one minute.

The following examples are illustrative of the invention and are not intended to limit it.

EXAMPLE 1

A liter of concentrate was prepared containing the following quantities of ingredients:

| | per liter |
|---|---|
| $H_2SO_4$(66° Baumé) | 467.2 g (256 ml) |
| $H_2O$ | 709.6 g (711 ml) |
| MIRAWET B | 88.6 g (80 ml) |

The above concentrate was clear and substantially colorless. 60.0 ml of the above concentrate was added to 5.940 liters of water to form six liters of solution containing 4.67 grams/liter of $H_2SO_4$ (66° Baumé) and 0.434 grams/liter of sodium 2-butoxyethoxyacetate (0.886 g/l of MIRAWET B). 20 PPM of hydrofluoric acid was added to form the cleaning solution, and the cleaning solution stirred to render it uniform in composition.

Aluminum cans of 3004 alloy drawn into single piece containers were employed in this procedure. The cans were covered with aluminum fines and drawing oils.

The test specimens were treated as follows:

(a) Sprayed with the above cleaning solution maintained at 130° F. for one minute, (b) rinsed with water by immersion in cold water for 30 seconds, (c) allowed to stand for 30 seconds, after which they were examined for water breaks on both the inside and outside, and (d) the inside wiped with a clean white cloth and the cloth examined for aluminum fines.

A can was tested as above and the results noted. Then 5 ml of a cooling oil emulsion used by Reynolds Aluminum Company in the drawing and forming of aluminum cans was added to the cleaning solution and another can tested and the results noted. Another 5 ml of cooling oil was then added to the bath and another can was tested and the results noted. Additional 5 ml increments of cooling oil were added and a can tested after each addition until water breaks were obtained. Upon each addition of cooling oil, the amount of foam in the bath was noted.

The results of these tests are given in Table I below:

TABLE I

| Addition of Cooling Oil Emulsion | Extent of Water Breaks | Aluminum Fines on Cloth | Foam in Bath |
|---|---|---|---|
| 0 | None | None | None |
| 5 ml | None | None | Very slight* |
| 10 ml | None | None | Very slight |
| 15 ml | None | None | Very slight |
| 20 ml | None | None | Very slight |
| 25 ml | None | None | Very slight |
| 30 ml | Slight | None | Very slight |

*no greater than ¼" of foam.

EXAMPLE 2

Six liters of cleaning solution were prepared by adding to water 28.02 grams of $H_2SO_4$(66° Baumé), 1.30 grams of sodium 2-butoxyethoxyacetate, and 20 PPM of hydrofluoric acid. This cleaning solution contains 4.67 grams/liter of $H_2SO_4$(66° Baumé) and 0.217 grams/liter of sodium 2-butoxyethoxyacetate (i.e. one-half the amount present in the cleaning solution of Example 1).

Aluminum cans from the same batch as were used in Example 1 were tested according to the conditions and procedures set forth in Example 1 with the following results:

TABLE II

| Addition of Cooling Oil Emulsion | Extent of Water Breaks | Aluminum Fines on Cloth | Foam in Bath |
|---|---|---|---|
| 0 | None | None | None |
| 5 ml | None | None | Very slight* |
| 10 ml | None | None | Very slight |
| 15 ml | None | None | Very slight |
| 20 ml | None | None | Very slight |
| 25 ml | None | None | Very slight |
| 30 ml | Slight | None | Very slight |

*no greater than ¼" of foam.

EXAMPLE 3

Six liters of an aqueous cleaning solution were prepared containing the following quantities of ingredients per liter:

| | |
|---|---|
| $H_2SO_4$(66° Baumé) | 4.67 g |
| Sodium 2-ethyl hexyl sulfate | 0.464 g (0.98 ml of TERGITOL ANIONIC 08) |
| HF | 20 PPM |

Aluminum cans from the same batch as those used in Example 1 were tested according to the conditions and procedures set forth in Example 1 with the following results:

TABLE III

| Addition of Cooling Oil Emulsion | Extent of Water Breaks | Aluminum Fines on Cloth | Foam in Bath |
|---|---|---|---|
| 0 | Slight | None | None |
| 5 ml | Extensive* | None | None |
| 10 ml | Extensive | None | None |

*commercially unacceptable.

EXAMPLE 4

Six liters of an aqueous cleaning solution were prepared containing the quantities of ingredients set forth in Example 3 except that 0.928 g/l of sodium 2-ethyl hexyl sulfate was used. Test procedures were carried out as in Example 3 with the following results:

TABLE IV

| Addition of Cooling Oil Emulsion | Extent of Water Breaks | Aluminum Fines on Cloth | Foam in Bath |
|---|---|---|---|
| 0 | Slight | None | None |
| 5 ml | Extensive* | None | None |
| 10 ml | Extensive | None | None |

*commercially unacceptable.

EXAMPLE 5

Six liters of an aqueous cleaning composition was prepared containing the following quantities of ingredients per liter:

| | |
|---|---|
| $H_2SO_4$(66° Baumé) | 4.70 g |
| Ethoxylated abietic acid (Hercules Surfactant AR 150)* | 1.053 g |
| Alkyl poly(ethyleneoxy)-ethanol (ANTAROX LF-330)* | 0.673 g |
| HF | 20 PPM |

*both nonionic surfactants.

Aluminum cans from the same batch as those used in Example 1 were treated according to the procedure and conditions set forth in Example 1 with the following results:

TABLE V

| Addition of Cooling Oil Emulsion | Extent of Water Break | Aluminum Fines on Cloth | Foam in Bath |
|---|---|---|---|
| 0 | None | Trace | Slight** |
| 5 ml | Slight | Trace | Slight |
| 10 ml | Extensive* | Trace | Slight |

*commercially unacceptable
**between ¼" and 1".

EXAMPLE 6

Six liters of an aqueous cleaning solution were prepared containing the following quantities of ingredients per liter:

| | |
|---|---|
| $H_2SO_4$(66° Baumé) | 4.67 grams |
| Modified polyethoxylated straight chain alcohol (TRITON DF-16) (nonionic surfactant) | 0.464 g. |
| HF | 20 PPM |

Aluminum cans from the same batch as those used in Example 1 were treated according to the same procedures and conditions set forth in Example 1 with the following results:

TABLE VI

| Addition of Cooling Oil Emulsion | Extent of Water Breaks | Aluminum Fines on Cloth | Foam in Bath |
|---|---|---|---|
| 0 | None | Trace | Slight* |
| 5 ml | None | Trace | Slight |
| 10 ml | None | Trace | Slight |

TABLE VI-continued

| Addition of Cooling Oil Emulsion | Extent of Water Breaks | Aluminum Fines on Cloth | Foam in Bath |
|---|---|---|---|
| 15 ml | None | Trace | Slight |
| 20 ml | None | Trace | Slight |
| 25 ml | Slight | Trace | Slight |

*between ¼" and 1".

EXAMPLE 7

The following concentrates were prepared:

| | per liter |
|---|---|
| A | |
| $H_2SO_4$(66° Baumé) | 467.2 g |
| $H_2O$ | 709.6 g |
| Sodium 2-butoxyethoxy-acetate | 43.4 g |
| B | |
| $H_2SO_4$(66° Baumé) | 467.2 g |
| $H_2O$ | 709.6 g |
| Sodium 2-ethyl hexyl sulfate | 46.4 g |
| C | |
| $H_2SO_4$(66° Baumé) | 469.6 g |
| $H_2O$ | 627.0 g |
| Ethoxylated abietic acid (Hercules Surfactant AR 150) | 105.3 g |
| Alkyl poly (ethyleneoxy) ethanol (ANTAROX LF-330) | 67.3 g |
| D | |
| $H_2SO_4$(66° Baumé) | 467.2 g |
| $H_2O$ | 709.6 g |
| Modified polyethoxy-lated straight chain alcohol (TRITON DF-16) | 46.4 g |

Samples of the above concentrates were treated according to the conditions shown and with the results set forth in Table VII below:

TABLE VII

| Concentrate | Dry Ace/ Acetone Bath | 0° C. for 24 hours | 55° C. for 24 hours |
|---|---|---|---|
| A | Sl. viscous clear, substantially colorless solution | Clear, substantially colorless solution | Clear, substantially colorless solution |
| B* | — | — | — |
| C | Significant precipitate | Significant precipitate | Very dark brown discoloration, some separation into layers |
| D | Sl. viscous, lightly colored brown solution | Lightly colored brown solution | Moderately colored brown solution |

*Homogeneous solution could not be obained. TERGITOL 08 layered on top of the sulfuric acid solution.

Concentrate A was then placed in an oven maintained at 50° C. for a period of three weeks. When the solution was removed, it was clear and substantially colorless, i.e. no change in color occurred during this period.

EXAMPLE 8

Six liters of an aqueous cleaning solution was prepared containing the following quantities of ingredients per liter:

| | |
|---|---|
| $H_2SO_4$(66° Baumé) | 4.7 g |
| MIRAWET B | 0.9 g |
| HF | 20 PPM |

Aluminum cans of 3004 alloy drawn into single piece containers were employed in this procedure. The cans were covered with aluminum fines and drawing oils.

The test specimens were treated as follows:

(a) Sprayed with the above cleaning solution maintained at 125° F., (b) rinsed with water by immersion in cold water for 30 seconds, and (c) allowed to stand for 30 seconds, after which they were examined for water breaks on both the inside and outside.

A can was tested as above with a spray time in step (a) of 30 seconds, and the results noted. A second can was tested as above with a spray time in step (a) of 45 seconds and the results noted. Then 200 PPM of NALCO XL 174, a mineral oil based coolant and lubricant for drawing and ironing aluminum cans was added to the cleaning solution, and a third can was tested as above with a spray time in step (a) of 30 seconds, and a fourth can with a spray time in step (a) of 45 seconds.

The results of these tests are given in Table VIII below:

TABLE VIII

| Addition of NALCO XL 174, PPM | Spray Time in Seconds | Extent of Water Breaks |
|---|---|---|
| 0 | 30 | None |
| 0 | 45 | None |
| 200 | 30 | None |
| 200 | 45 | None |

EXAMPLE 9

Six liters of cleaning solution were prepared by adding to water 4.7 g/l of $H_2SO_4$ (66° Baumé), 1.053 g/l of Hercules Surfactant AR-150, 0.673 g/l of SURFONIC LF 17, and 20 PPM of hydrofluoric acid.

Aluminum cans from the same batch as were used in Example 8 were tested according to the conditions and procedures set forth in Example 8 with the following results:

TABLE IX

| Addition of NALCO XL 174, PPM | Spray Time in Seconds | Extent of Water Breaks |
|---|---|---|
| 0 | 30 | None |
| 0 | 45 | None |
| 200 | 30 | Extensive |
| 200 | 45 | Slight |

EXAMPLE 10

Six liters of an aqueous cleaning solution heavily contaminated with NALCO XL 174 was prepared containing the following quantities of ingredients per liter:

| | |
|---|---|
| $H_2SO_4$(66° Baumé) | 4.7 g |
| MIRAWET B | 0.9 g |
| HF | 20 PPM |
| NALCO XL 174 | 500 PPM |

Aluminum cans of 3004 alloy drawn into single piece containers were employed in this procedure. The cans were covered with aluminum fines and drawing oils.

The test specimens were treated as follows:

(a) Washed with tap water at 125° F. for 30 seconds, (b) sprayed with the above cleaning solution maintained at 125° F. for 40 seconds, (c) rinsed by spraying with tap water for 20 seconds, (d) rinsed by spraying with deionized water, and (e) allowed to stand for 30 seconds, after which they were examined for water breaks on both the inside and outside.

A can was tested as above and the results noted. Then to a portion of the above contaminated cleaning solution was added 0.9 g/l of a low foaming nonionic surfactant, and another can tested as above. This procedure was repeated with the addition of 0.9 g/l of different low foaming nonionic surfactants to fresh portions of the above contaminated cleaning solution. The results obtained are given in Table X below:

TABLE X

| Addition of 0.9 g/l of nonionic surfactant | Extent of Water Breaks |
|---|---|
| None | Extensive |
| PLURAFAC RA 30 | Slight |
| TRITON DF 16 | None |
| SURFONIC LF 7 | None |
| SURFONIC LF 17 | None |
| ANTAROX LF 330 | Moderate |

As can be seen in this example, even when a very heavy contaminant of a commercially used coolant is present in the compositions of the invention, the presence of a small quantity of a low foaming nonionic surfactant in addition to the alkali metal 2-butoxyethoxyacetate significantly increases the cleaning ability of the composition.

I claim:

1. An aqueous cleaning composition for removing and dissolving aluminum fines and cleaning lubricating oils from aluminum surfaces comprising from about 1 to about 10 grams/liter of sulfuric acid, from about 0.005 to about 0.1 grams/liter of hydrofluoric acid, and from about 0.1 to about 10 grams/liter of alkali metal 2-butoxyethoxyacetate.

2. The composition of claim 1 wherein the alkali metal 2-butoxyethoxyacetate is sodium 2-butoxyethoxyacetate, and is present in amount from about 0.2 to about 0.8 grams/liter of cleaning composition.

3. The composition of claim 1 wherein the pH is from about 1.0 to about 1.8.

4. The aqueous cleaning composition of claim 2 wherein the sulfuric acid is present in amount of from about 3 to about 5 grams/liter, and the hydrofluoric acid is present in amount of from about 0.01 to about 0.03 grams/liter.

5. The aqueous cleaning composition of claim 1, 2, 3, or 4 wherein the hydrofluoric acid is present in an amount such that the composition has an aluminum dissolution rate of from about 8 to about 25 milligrams per square foot of aluminum surface treated at a temperature of 130° F. and a contact time of one minute.

6. An aqueous cleaning composition in accordance with claim 1, 2, 3, or 4 wherein from about 0.1 to about 10 grams/liter of one or a mixture of at least two low foaming nonionic surfactants is also present in the composition.

7. An aqueous cleaning composition in accordance with claim 1, 2, 3, or 4 wherein from about 0.2 to about 0.8 grams/liter of one or a mixture of at least two low foaming nonionic surfactants is also present in the composition.

8. A process for cleaning an aluminum surface comprising the steps of (a) contacting said surface with an aqueous cleaning solution comprising from about 1 to about 10 grams/liter of sulfuric acid, from about 0.005 to about 0.1 grams/liter of hydrofluoric acid, and from about 0.1 to about 10 grams/liter of alkali metal 2-butoxyethoxyacetate, and (b) rinsing the aluminum surface to remove the cleaning solution.

9. The process of claim 8 wherein the alkali metal 2-butoxyethoxyacetate is sodium 2-butoxyethoxyacetate and is present in amount of from about 0.2 to about 0.8 grams/liter of cleaning solution.

10. The process of claim 8 wherein the aqueous cleaning solution is contacted with an aluminum surface by spraying said solution onto the surface.

11. The process of claim 8 wherein the solution temperature is maintained in the range of from about 115° F. to about 145° F.

12. The process of claim 8 wherein said cleaning solution comprises from about 3 to about 5 grams/liter of sulfuric acid, from about 0.01 to about 0.03 grams/liter of hydrofluoric acid, and from about 0.2 to about 0.8 grams/liter of sodium 2-butoxyethoxyacetate.

13. The process of claim 8, 9, 10, 11, or 12 wherein from about 0.1 to about 10 grams/liter of one or a mixture of at least two low foaming nonionic surfactants is also present in said aqueous cleaning solution.

14. The process of claim 8, 9, 10, 11, or 12 wherein from about 0.2 to about 0.8 grams/liter of one or a mixture of at least two low foaming nonionic surfactants is also present in said aqueous cleaning solution.

15. The process of claim 13 wherein the aluminum surface is an aluminum can.

16. The process of claim 14 wherein the aluminum surface is an aluminum can.

* * * * *